US006406171B1

(12) United States Patent
Satsukawa et al.

(10) Patent No.: US 6,406,171 B1
(45) Date of Patent: Jun. 18, 2002

(54) VEHICLE INDICATOR LAMP

(75) Inventors: Hideaki Satsukawa; Hiroshi Kawashima; Yasuyuki Amano, all of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/484,806

(22) Filed: Jan. 18, 2000

(30) Foreign Application Priority Data

Jan. 21, 1999 (JP) ..... 11-013567

(51) Int. Cl.[7] ..... F21V 17/00

(52) U.S. Cl. ..... 362/518; 362/520; 362/538; 362/308; 362/323; 362/343

(58) Field of Search ..... 362/518, 538, 362/520, 304, 307, 308, 328, 343, 350

(56) References Cited

U.S. PATENT DOCUMENTS 4,494,176 A * 1/1985 Sands et al. ..... 362/297
4,495,552 A * 1/1985 Graff ..... 362/297
4,959,757 A * 9/1990 Nakata ..... 362/518
5,469,339 A 11/1995 Iiyama et al. ..... 362/297
5,931,566 A * 8/1999 Fraizer ..... 362/293

* cited by examiner

*Primary Examiner*—Stephen Husar
(74) *Attorney, Agent, or Firm*—Fish & Richardson P.C.

(57) ABSTRACT

A vehicle indicator lamp includes a reflector having a diffusing and reflecting function that increases the lamp fixture efficiency by eliminating the loss of reflected light. The structure includes a reflector 14 having a reflective surface 14*a* which diffuses and reflects light forward from a light-source bulb 12 arranged in a lamp fixture reference axis Ax, and a transparent lens 16 in front of the reflector 14. The reflective surface 14*a* is formed such that the inner peripheral edge region 14*a*1 thereof radiates reflected light in a direction substantially parallel to the lamp fixture reference axis Ax, while the outer peripheral edge region 14*a*2 thereof radiates reflected light in a direction near the light fixture reference axis Ax. Consequently, the diffused and reflected light from the reflected surface 14*a* is not blocked by either the light-source bulb 12 or the standing wall 14*c* of the reflective surface outer peripheral edge, thereby substantially eliminating the loss of reflected light.

8 Claims, 8 Drawing Sheets

VEHICLE INDICATOR LAMP

BACKGROUND OF THE INVENTION

The present invention generally relates to a vehicle indicator lamp provided with a reflector having a diffusing and reflecting function. The invention is particularly suitable for use in a small vehicle indicator lamp.

In recent years, a vehicle indicator lamp has been proposed (see FIG. 8) wherein a reflective surface 104*a* of a reflector 104 is formed of a plurality of diffusive and reflective elements 104*s* such that reflecting light from a light-source bulb 102 forward as diffused light enables a predetermined light distribution pattern to be obtained, in addition to forming a lens 106 of a transparent lens so as to give a sense of transparency to the lamp fixture. However, when this type of structure is employed, some of the diffused and reflected light from the reflective surface 104*a* is blocked by the light-source bulb 102 and the standing wall 104*b* of the outer peripheral side of the reflective surface 104*a* , resulting in a proportional loss of reflected light, as shown in FIG. 8.

This type of loss of reflected light does not pose any particular problem in a large lamp fixture. However, as the lamp fixture is made smaller, the amount of light transmitted from the reflective surface 104*a* decreases such that the loss of reflected light becomes noticeable. As a result, there is the problem of reduced efficiency of the lamp fixture.

SUMMARY OF THE INVENTION

In view of the foregoing problem, an implementation of the present invention provides a small vehicle indicator lamp with a reflector having a diffusing and reflecting function that increasing the lamp fixture efficiency by substantially eliminating the loss of reflected light.

The present invention achieves the foregoing by providing a technique for constructing the reflective surface of the reflector.

According to the present invention, a vehicle indicator lamp is provided with a light-source bulb arranged in a light fixture reference axis extending in the front/rear direction, a reflector having a reflective surface which diffuses and reflects the light forward from the light-source bulb, and a transparent lens in front of the reflector. The reflective surface is formed such that the inner peripheral edge region of the reflective surface radiates reflected light in a direction substantially parallel to the lamp fixture reference axis, while the outer peripheral edge region of the reflective surface radiates reflected light in a direction near the lamp fixture reference axis.

The above-mentioned "transparent lens" may be formed to be transparent across the entire front surface. It may also have a lens function for a portion thereof.

The regions other than the inner peripheral edge region and the outer peripheral edge region in the above-mentioned "reflective surface" are not limited to the specific reflective surface shape thereof.

The above-mentioned "direction substantially parallel to the lamp fixture reference axis" includes not only the direction substantially parallel to the lamp fixture reference axis, but also a diagonal direction with respect to the lamp fixture reference axis within a range in which the reflected light from the inner peripheral edge region is not blocked by the light-source bulb.

The vehicle indicator lamp according to the present invention is constructed so as to diffuse and reflect the light forward from the light-source bulb, wherein the reflective surface of the reflector of the vehicle indicator lamp is arranged in the lamp fixture reference axis. The reflective surface is formed such that the inner peripheral edge region thereof radiates reflected light in a direction substantially parallel to the lamp fixture reference axis while the outer peripheral edge region thereof radiates reflected light in a direction near the lamp fixture reference axis. Consequently, the diffused and reflected light from the reflected surface is not blocked by the light-source bulb and the standing wall of the reflective surface outer peripheral side, thereby substantially eliminating the loss of reflected light. Therefore, lamp fixture efficiency is increased even when a lamp fixture is made smaller.

Therefore, a small vehicle indicator lamp provided with a reflector having a diffusing and reflecting function according to the present invention can be realized having increased lamp fixture efficiency due to the substantial elimination of the loss of reflected light.

In the foregoing structure a shape determination method of the reflective surface is not specifically defined. However, the shape of the reflective surface may be determined by dividing the light distribution pattern which should radiate according to the diffused and reflected light into a plurality of pattern regions and calculating the light beam required to obtain the radiated light of the pattern region for each of the pattern regions, while dividing the reflective surface into a plurality of reflective regions corresponding to each of the pattern regions at the solid angle required to obtain the light beam calculated for each of the pattern regions, and setting the gradient distribution of each of these reflective regions such that the reflected light from the reflective region is radiated to each of the pattern regions. Thus, trial and error to obtain the target light distribution pattern is eliminated and a reflector which radiates light forward in the target light distribution pattern may be obtained with one design fabrication. Consequently, lamp fixture development time may be shorted and development cost reduced.

In the foregoing structure, if the construction is such that a condenser lens portion is included that focuses the light from the light-source bulb near the lamp fixture reference axis, wherein the condenser lens is formed on a portion positioned in front of the lamp-source bulb in the transparent lens, the following operation and effect can be achieved.

In a conventional vehicle indicator lamp, since direct light from the light-source bulb 102 toward the transparent lens 106 becomes light which simply expands radially, the direct light contributes almost nothing to the formation of the lamp fixture light distribution pattern and the portion in front of the light-source bulb of the transparent lens 106 is not used efficiently for light distribution control. In contrast, if a condenser lens portion is formed, the portion in front of the light-source bulb of the transparent lens can be used efficiently for light distribution control. As a result, lamp fixture efficiency can be improved and the lamp fixture can be made that much smaller. In addition, when observing the lamp fixture from the front, the condenser lens portion appears to float on the lens surface and the back of the reflective surface is visible through the surrounding transparent lens portion, thereby giving a three-dimensional appearance and a sense of depth to the lamp fixture.

When a light distribution control function is added to both the lens and the reflector in this way, it generally becomes difficult to accurately control the light distribution of the lamp fixture. However, since the condenser lens portion is formed on the portion in front of the light-source bulb and the portion in front of the reflective surface is a transparent lens portion, functions can be divided to some extent with the focusing of the direct light from the light-source bulb controlled by the condenser lens portion, and the diffusion and reflection of the admitted light from the light-source bulb controlled by the reflective surface. Therefore, light diffusion of the lamp fixture is able to be controlled relatively accurately.

In this case, if the reflective surface is formed so as to admit substantially all of the diffused and reflected light from the reflective surface to a transparent lens portion, the functions can be almost entirely divided with direct light focus controlled by the condenser lens portion and diffusion and reflection controlled by the reflective surface. As a result, the light distribution of the lamp fixture can be controlled accurately.

The shape setting method of the condenser lens portion is not specifically limited. However, if the shape is set by dividing the light distribution pattern which should be radiated according to the transparent light of the condenser lens portion into a plurality of pattern regions and calculating the light beam required to obtain the radiated light of the pattern region for each of these pattern regions, while dividing the condenser lens portion into the plurality of lens regions corresponding to each of the pattern regions at the solid angle required to obtain the light beam calculated for each of the pattern regions, and setting the prism vertical angle distribution of each of these lens regions such that the transparent light from the lens region is radiated to each of the pattern regions, then trial and error to obtain the target light distribution pattern is eliminated and a lens which radiates forward of the lamp fixture with the target light distribution pattern is able to be obtained with one design fabrication.

An embodiment of the present invention will be hereinafter described with reference to the drawings.

DETAILED DESCRIPTION

Figure 1:
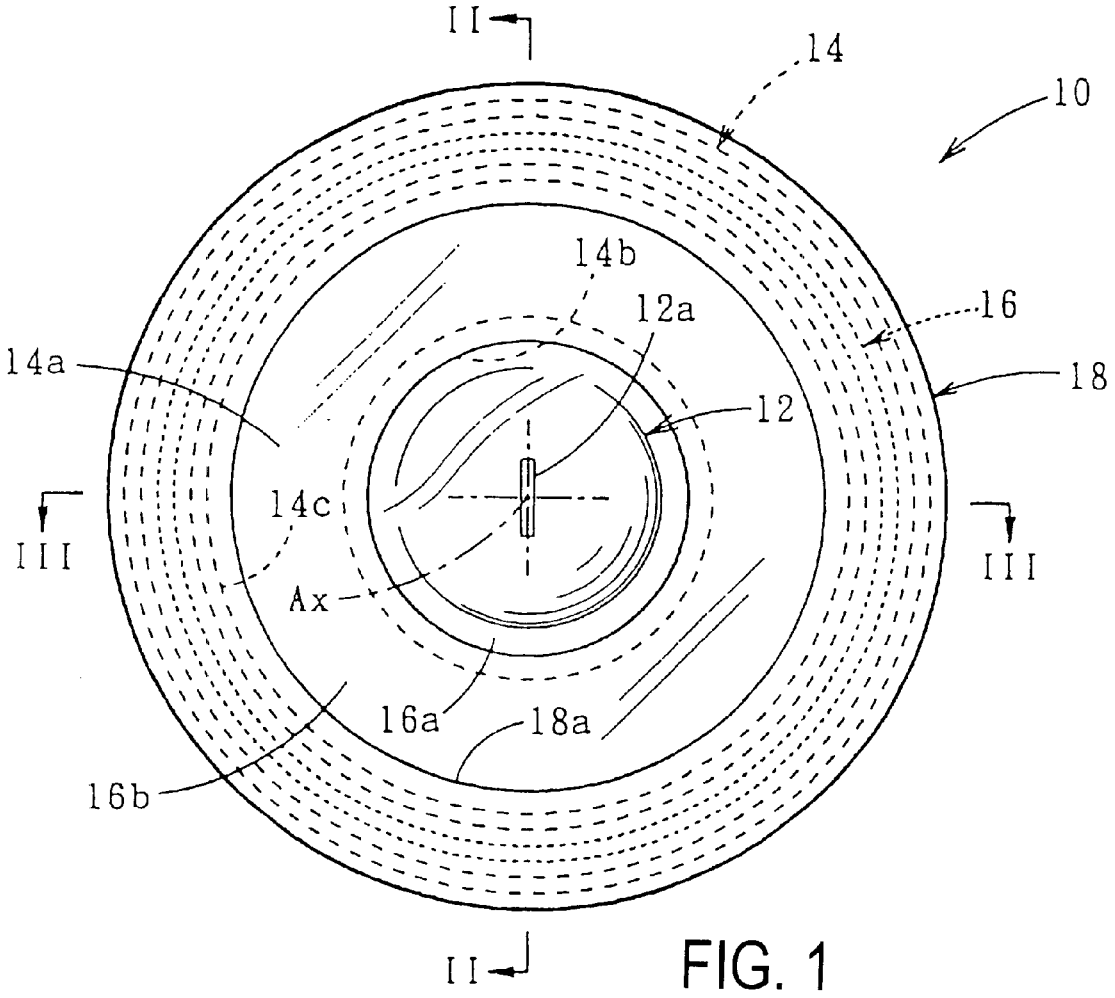
FIG. 1 is a front view of a vehicle indication lamp according to one embodiment of the present invention.

As shown in the drawings, a vehicle indicator lamp 10 according to the present embodiment may be a small front turn signal lamp having a circular outer shape when viewing the vehicle fixture from the front. The signal lamp includes a light-source bulb 12 having a filament 12*a* (light source) extending perpendicular to a lamp fixture reference axis (light axis) Ax extending in the front/rear direction, a reflector 14 which fixedly supports this light-source bulb 12 in the lamp fixture reference axis Ax, a transparent lens 16 arranged in front of this reflector 14, and a cover 18 composed of a nontransparent member which covers the outer peripheral edge portion of the transparent lens 16.

The reflector 14 has a bulb insertion hole 14*b* formed in the rear apex portion into 14 which the light-source bulb 12 is inserted. A reflective surface 14*a* is formed around this bulb insertion hole 14*b* and reflects the light generated from the (filament 12*a* of the) light-source bulb 12. A standing wall 14*c* surrounds the outer peripheral side of the reflective surface 14*a*.

A condenser lens portion 16*a* focuses the light from the light-source bulb 12 near the lamp fixture reference axis Ax. The condenser lens portion 16*a* is positioned in front of the light-source bulb 12 in the transparent lens 16. The outer shape of the condenser lens portion 16*a* is circular and is substantially the same size as the bulb insertion hole 14*b*. The circular transparent lens portion 16*b* in the transparent lens 16 surrounds the condenser lens portion 16*a*. The front surface of the condenser lens portion 16*a* is convex, formed like a piano-convex lens. However, the condenser lens portion 16*a* is not a simple piano-convex lens but is a deformed piano-convex lens in which the convex shape gradually changes according to the angle position around the lamp fixture reference axis Ax.

Figure 2:
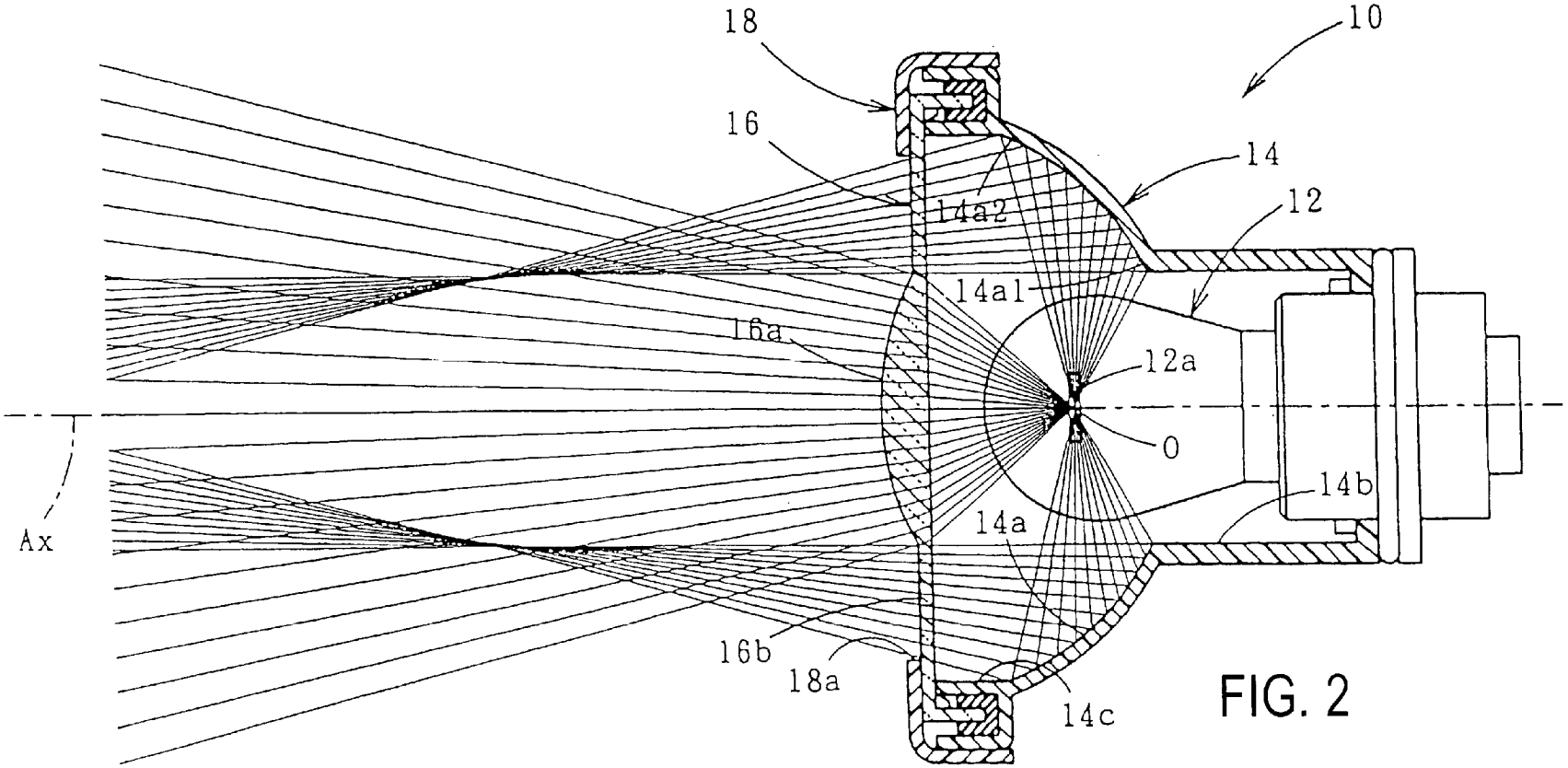
FIG. 2 is a cross-sectional view taken along line II—II of FIG. 1.

Referring to FIG. 2, the reflective surface 14*a* of the reflector 14 is formed such that the inner peripheral edge region 14*a*1 thereof radiates reflected light in a direction substantially parallel to the lamp fixture reference axis Ax while the outer peripheral edge region 14*a*2 thereof radiates reflected light in a direction near the light fixture reference axis Ax. The reflective surface 14*a* is constructed so as to transmit substantially all of the diffused and reflected light from the reflective surface 14*a* to the transparent lens portion 16*b* of the transparent lens 16. Thus, the reflective surface 14*a* is constructed to reflect substantially all of the light impinging on the reflective surface 14*a* from the center position (the point in the lamp fixture reference axis Ax) O of the filament 12*a* to the transparent lens portion 16*a* of the transparent lens 16. The reflective surface 14*a* is constructed with a smooth curved surface with no steps and ridges.

The present embodiment is constructed to radiate a predetermined light distribution pattern forward from the lamp fixture by controlling the diffusion and reflection of light from the light-source bulb 12 with the reflective surface 14*a* and by controlling the focus of direct light from the light-source bulb 12 with the condenser lens portion 16*a* . According to the present embodiment, the target light distribution pattern of the front turn signal lamp is divided into a first target light distribution pattern P1, which may be formed by the reflective surface 14*a*, and a second target light distribution pattern P2, which may be formed by the condenser lens portion 16*a* (see FIGS. 4 and 5). The shapes of the reflective surface 14*a* and the condenser lens portion 16*a* are determined based on the first target light distribution pattern P1 and the second target light distribution pattern P2, respectively.

The procedure for determining the shape of the reflective surface 14*a* and the condenser lens portion 16*a* will be hereinafter described. In the present embodiment, the first target light distribution pattern P1 and the second target light distribution pattern P2 are set to be the exact same pattern for the sake of simplifying the description.

Figure 4:
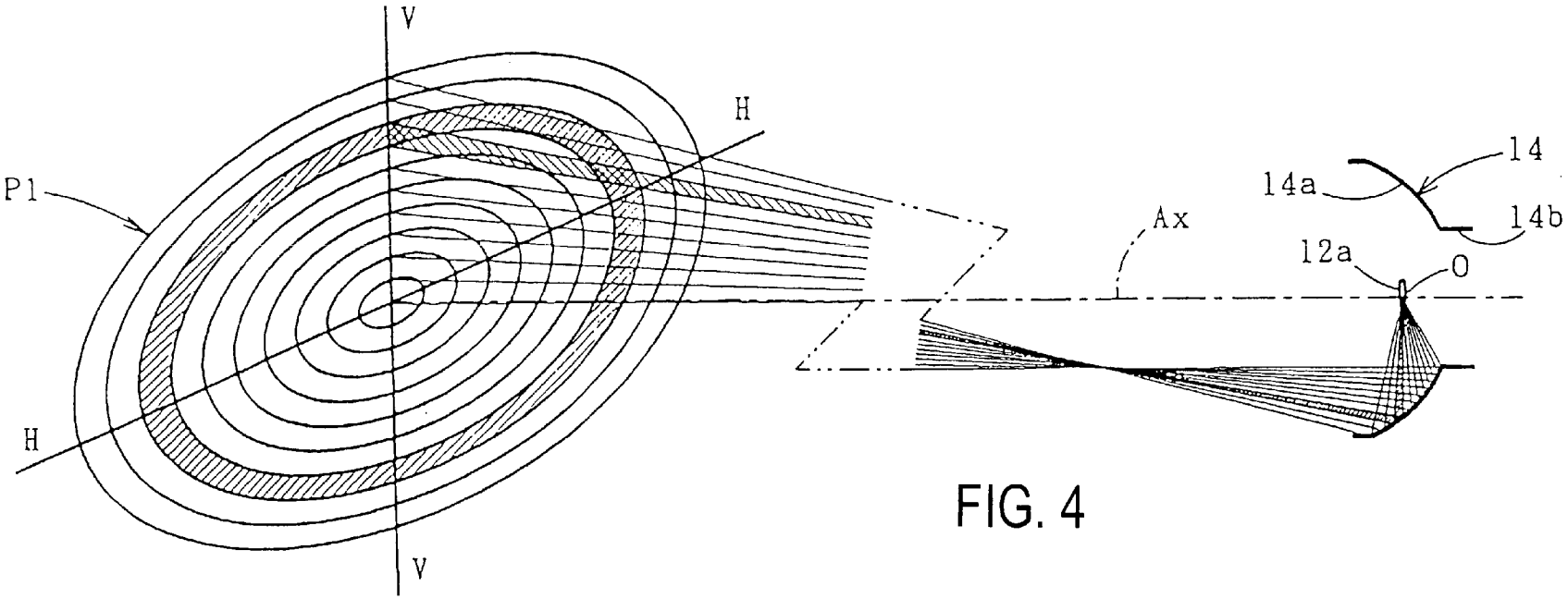
FIG. 4 is a perspective view for describing the shape determination procedure of the reflective surface.

The shape determination procedure of the reflective surface 14*a* will first be described. FIG. 4 is a perspective view diagram for describing the shape determination procedure of the reflective surface 14*a* . As shown, the first target light distribution pattern P1 is projected on a screen in front of the light fixture. The first target light distribution pattern P1 is an elliptical light distribution pattern which has a luminosity distribution in which the luminosity gradually decreases from the light fixture reference axis Ax toward the elliptic peripheral edge portion. In the first target light distribution pattern P1, equal luminosity curves are also multi-elliptical in shape. Thus, the first target light distribution pattern P1 is divided into a plurality of pattern regions of concentric elliptical shape with the light fixture reference axis Ax as the center. The light beam required to realize the radiated light distribution pattern for each pattern region is then calculated.

The reflective surface 14*a* of the reflector 14 is also divided into a plurality of pattern regions and the same number of reflective regions. Each of these reflective regions are divided concentrically with the lamp fixture reference axis Ax as the center, as well as being divided to obtain a solid angle measurement required to obtain the light beam. The gradient distribution of each reflective region is then determined such that the reflected light from the reflective region is radiated to each pattern region.

In this manner, the resulting reflective surface 14*a* has the largest curvature at the cross-section along line H—H (the cross-section III—III shown in FIG. 3) and becomes a concave curved surface wherein the curvature gradually decreases toward the cross-section along line V—V (the cross-section 11—11 in FIG. 2).

The shape determination procedure of the condenser lens portion 16*a* will next be described with regard to FIG. 5, which is a perspective view diagram for describing the shape determination procedure of the condenser lens portion 16*a*.

Figure 5:
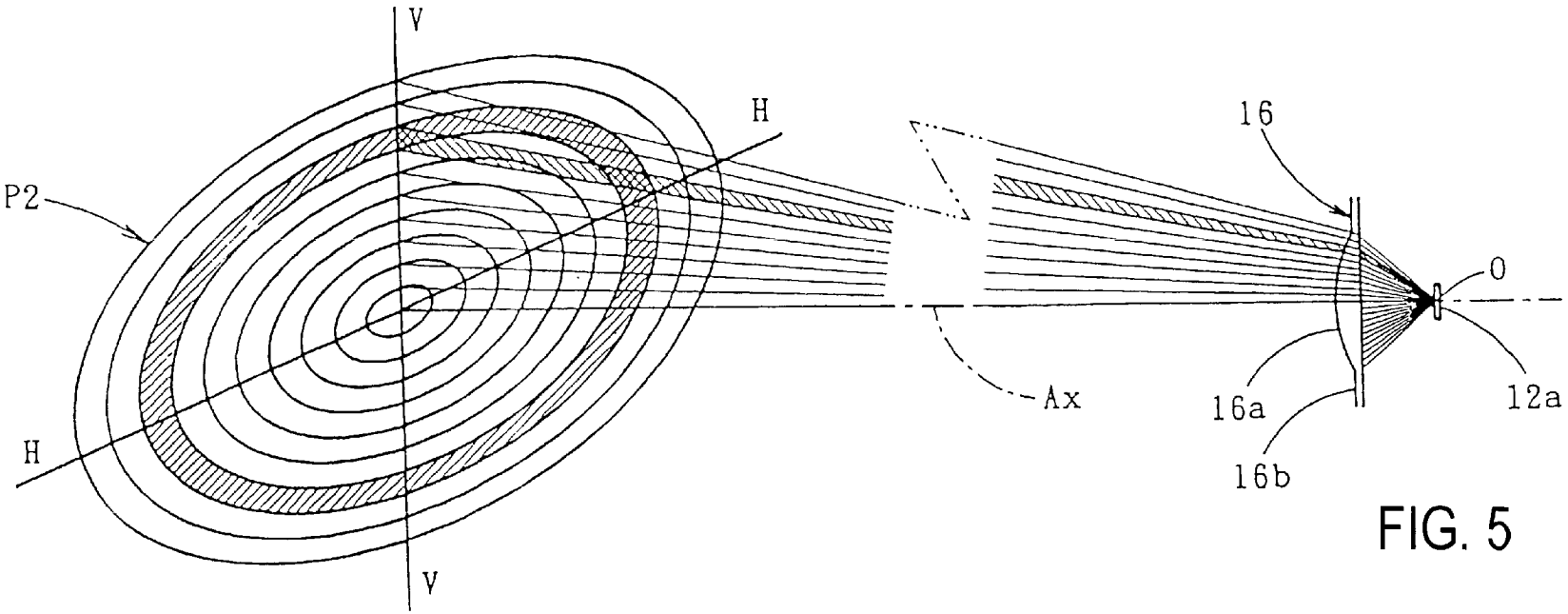
FIG. 5 is a perspective view for describing the shape determination procedure of a condenser lens portion.

As shown in FIG. 5, a second target light distribution pattern P2 is projected on a screen in front of the lamp fixture. The second target light distribution pattern P2 is set to the exact same light distribution pattern as the first target light distribution pattern P1, as mentioned above. Therefore the calculation method of the light beam required to obtain the amount of radiated light of each pattern region composing this second target light distribution pattern P2 is exactly the same as with the first target light distribution pattern P1.

The front surface of the condenser lens portion 16*a* of the transparent lens 16 is divided into the plurality of pattern regions and the same number of lens regions. Each of these lens regions is divided concentrically with the lamp fixture reference axis Ax as the center, as well as being divided to obtain the solid angle measurement required to calculate the light beam. Next the gradient distribution of each lens region is determined such that the transparent light from the lens region is radiated to each of the pattern regions.

Figure 3:
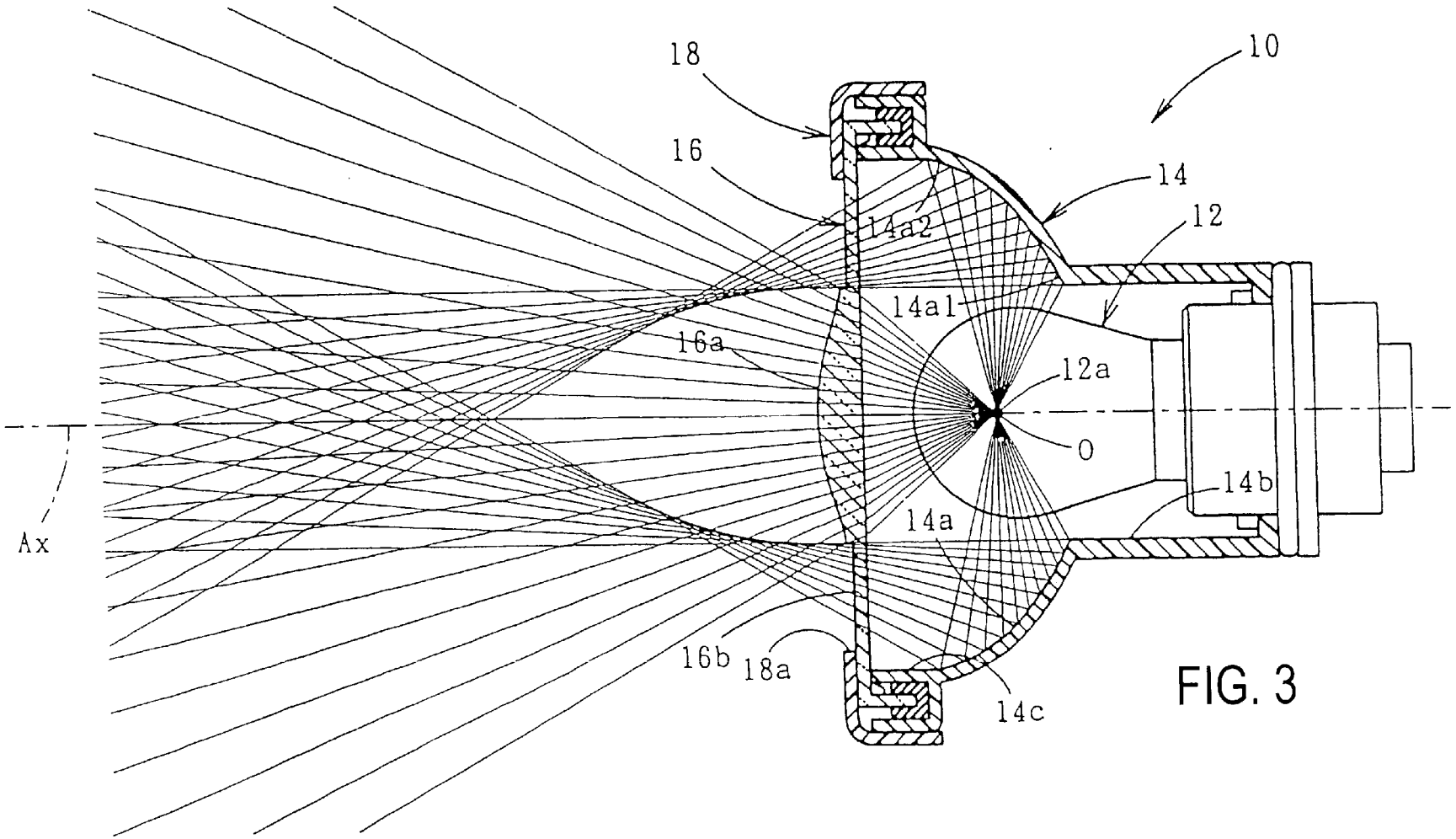
FIG. 3 is a cross-sectional view taken along line III—III of FIG. 1.

In this manner, the resulting condenser lens portion 16*a* has the largest curvature at the cross-section along line V—V (the cross-section II—II shown in FIG. 2) and has a convex curved surface wherein the curvature gradually decreases toward the cross-section along line H (the cross-section III—III shown in FIG. 3). Therefore, the peripheral edge portion of the condenser lens portion 16*a* differs in thickness between the cross-section along line V and the cross-section along line H. According to the present embodiment, in the cross-section along line V—V wherein the thickness of the peripheral edge portion of the condenser lens portion 16*a* is at its thinnest, the condenser lens portion 16*a* and the transparent lens portion 16*b* continue without a step. In the cross-section along line H—H, the condenser lens portion 16*a* protrudes forward with respect to the transparent lens portion 16*b*.

The covering 18 (see FIG. 1) covers the outer peripheral edge portion of the transparent lens 16 and includes an inner peripheral edge 18*a* having a circular shape with the lamp fixture reference axis Ax as the center, thereby framing the transparent lens portion 16*b* which is also a circular shape. The inner peripheral edge 18*a* of this covering 18 is formed in a position closer to the lamp fixture reference axis Ax than the outer peripheral edge of the reflective surface 14*a* to the greatest extent possible, in a range that does not block the diffused and reflected light from the reflective surface 14*a* of the reflector 14.

As described above, the vehicle indicator lamp 10 according to the present embodiment is provided with a light-source bulb 12, a reflector 14 which fixedly supports this light-source bulb 12 and which has a reflective surface 14*a* which reflects the light from the light-source bulb 12 forward, and a transparent lens 16 provided in front of the reflector 14. The reflective surface 14*a* is formed such that the inner peripheral edge region 14*a*1 thereof radiates reflected light in a direction substantially parallel to the lamp fixture reference axis Ax while the outer peripheral edge region 14*a*2 thereof radiates reflected light in a direction near the light fixture reference axis Ax. Consequently, the diffused and reflected light from the reflective surface 14*a* is not blocked by the light-source bulb 12 and the standing wall 14*c* of the reflective surface outer peripheral side, thereby substantially eliminating the loss of reflected light.

Therefore, the vehicle indicator lamp 10 according to the present embodiment, which in this example is a small front turn signal lamp, exhibits increased lamp fixture efficiency.

Also, according to the present embodiment, the condenser lens portion 16*a* focuses the light from the light-source bulb 12 near the lamp fixture reference axis Ax and is formed on a portion in front of the light-source bulb 12 in the transparent lens 16. Consequently, when observing the lamp fixture from the front, the condenser lens portion 16*a* appears to be a floating circle on the lens surface, and the back of the reflective surface 14*a* is visible through the surrounding circular transparent lens portion 16*b* , thereby presenting a three-dimensional appearance and a visual sense of depth to the lamp fixture.

In addition, in the present embodiment, a covering 18 is provided which covers the outer peripheral edge portion of the transparent lens 16. The circular-shaped inner peripheral edge 18*a* of the covering 18 is positioned closer to the lamp fixture reference axis Ax than the outer peripheral edge of the reflective surface 14*a*. As a result, the reflective surface 14*a*, which is positioned to the rear and separated from the covering 18 by a predetermined distance, is visible can be seen through the transparent lens portion 16*b* in the inner peripheral side of the covering 18. This adds to a three-dimensional appearance and sense of depth of the lamp fixture, thereby improving the appearance thereof.

Also, in the present embodiment, the outer diameter of the condenser lens portion 16*a* is the same size as the bulb insertion hole 14*b*, which also improves the appearance of the lamp fixture.

Furthermore, in the present embodiment, both the reflective surface 14*a* and the condenser lens portion 16*a* are constructed with a smooth curved surface with no steps and ridges. Consequently, a sense of transparency of the lamp fixture is increased, thereby further improving the appearance of the lamp fixture.

In the present embodiment, both the transparent lens 16 and the reflector 14 perform a light distribution control function. This generally makes it difficult to accurately control the light distribution of a lamp fixture. However, according to the present embodiment, the portion directly in front of the light-source bulb 12 is a condenser lens portion 16*a* and the portion in front portion of the reflective surface 14*a* is a transparent lens portion 16*b* . In addition, substantially all of the reflected light from the reflective surface 14*a* is transmitted to the transparent lens portion 16*b*. As a result, control of the light distribution functions can be almost equally divided between focusing the direct light from the light-source bulb 12 by the condenser lens portion 16*a*, and diffusion and reflection of the light from the light-source bulb 12 by the reflective surface 14*a*. Therefore, light distribution of the lamp fixture can be accurately controlled.

Further, it is possible to efficiently use the portion in front of the light-source bulb 12 in the transparent lens 16 for light distribution control, which was not efficiently exploited in the past. Consequently, light fixture efficiency may be increased and the lamp fixture can be made that much smaller. In particular, as with the vehicle indicator lamp 10 according to the present embodiment, when the lamp fixture is a front turn signal lamp it is often positioned close to a head lamp and sufficient space to install the lamp fixture cannot be ensured. Therefore, the capability to reduce the size of the lamp fixture by improving the lamp fixture efficiency is extremely effective.

Moreover, the vehicle indicator lamp 10 according to the present embodiment is constructed to obtain a target light distribution pattern of a front turn signal lamp by synthesizing the first target light distribution pattern P1 formed by the reflective surface 14*a* of the reflector 14 and the second target light distribution pattern P2 formed by the condenser lens portion 16*a* of the transparent lens 16. The shape of the reflective surface 14*a* is determined based on the first target light distribution pattern P1 and the shape of the condenser lens portion 16*a* is determined based on the second target light distribution pattern P2. This eliminates the conventional trial and error method of light fixture design in which numerous corrections of the shape of the reflective surface and lens were made to obtain the target light distribution pattern. Further, this technique enables a reflector and lens to be designed in one process that radiates light forward of the lamp fixture with the required target light distribution pattern. The ability to easily obtain the target light distribution pattern in this manner shortens the development time and reduces the development cost of the lamp fixture.

In the foregoing embodiment, the outer diameter of the condenser lens portion 16*a* is set to the same size as the bulb insertion hole 14*b*. However, it is of course possible to employ other constructions. Also, in the foregoing embodiment, the first target light distribution pattern P1 and the second target light distribution pattern P2 are set to the exact same light distribution pattern. However, they may of course also be set to different light distribution patterns.

Figure 6:
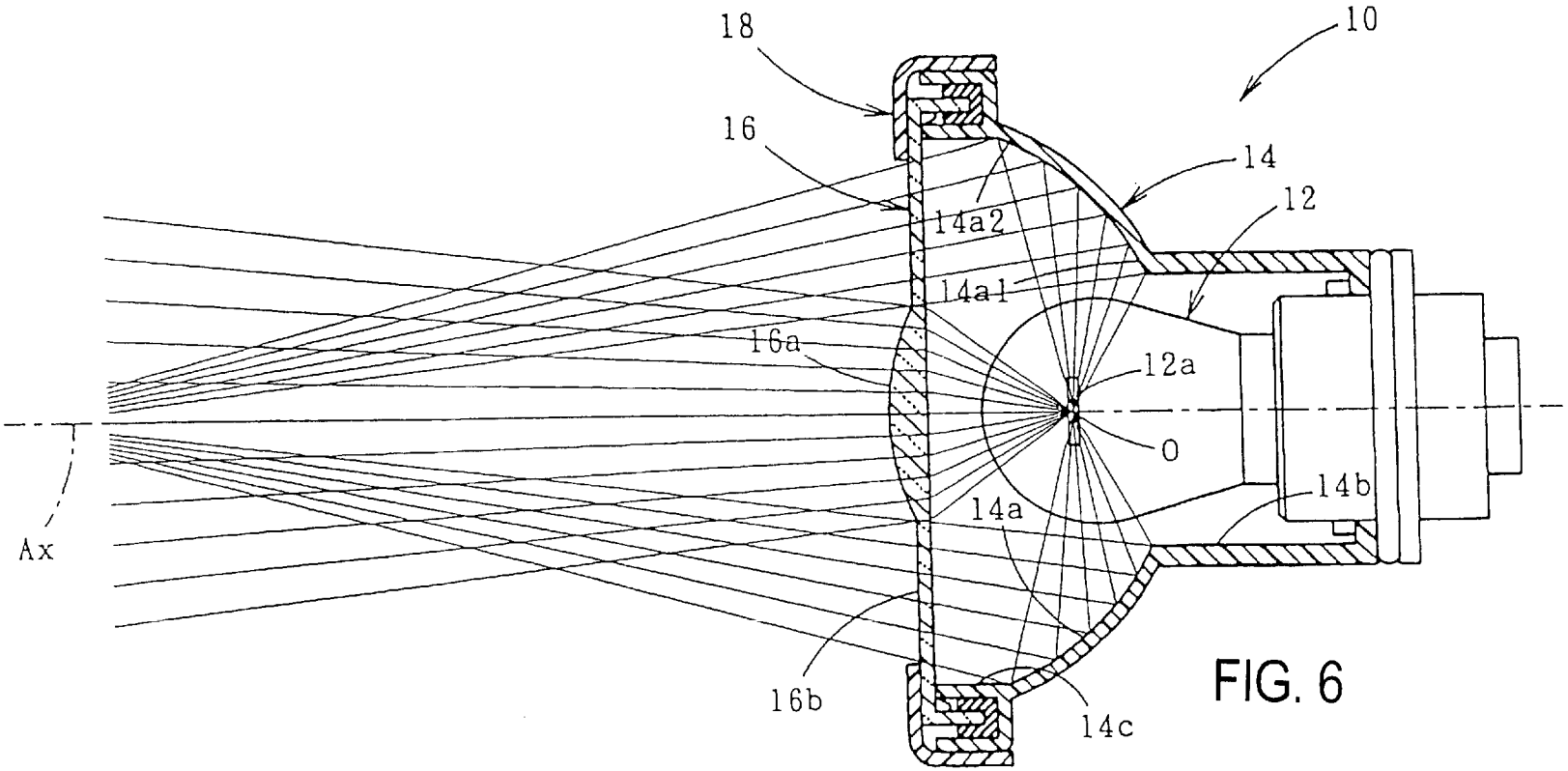
FIG. 6 is a cross-sectional side view of a modified implementation of the embodiment of FIG. 2.
Figure 7:
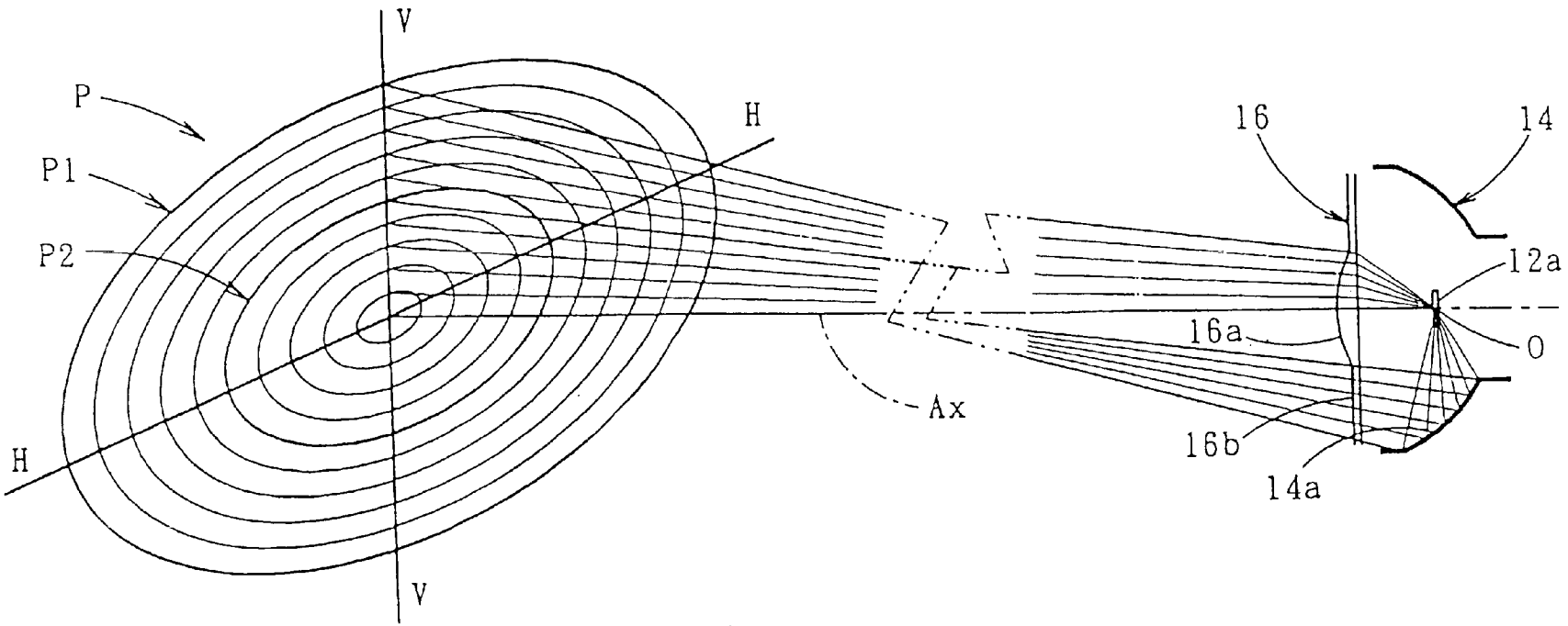
FIG. 7 is a view of a light distribution pattern obtained by the modified implementation of FIG. 6 which is similar to FIG. 4.
Figure 8:
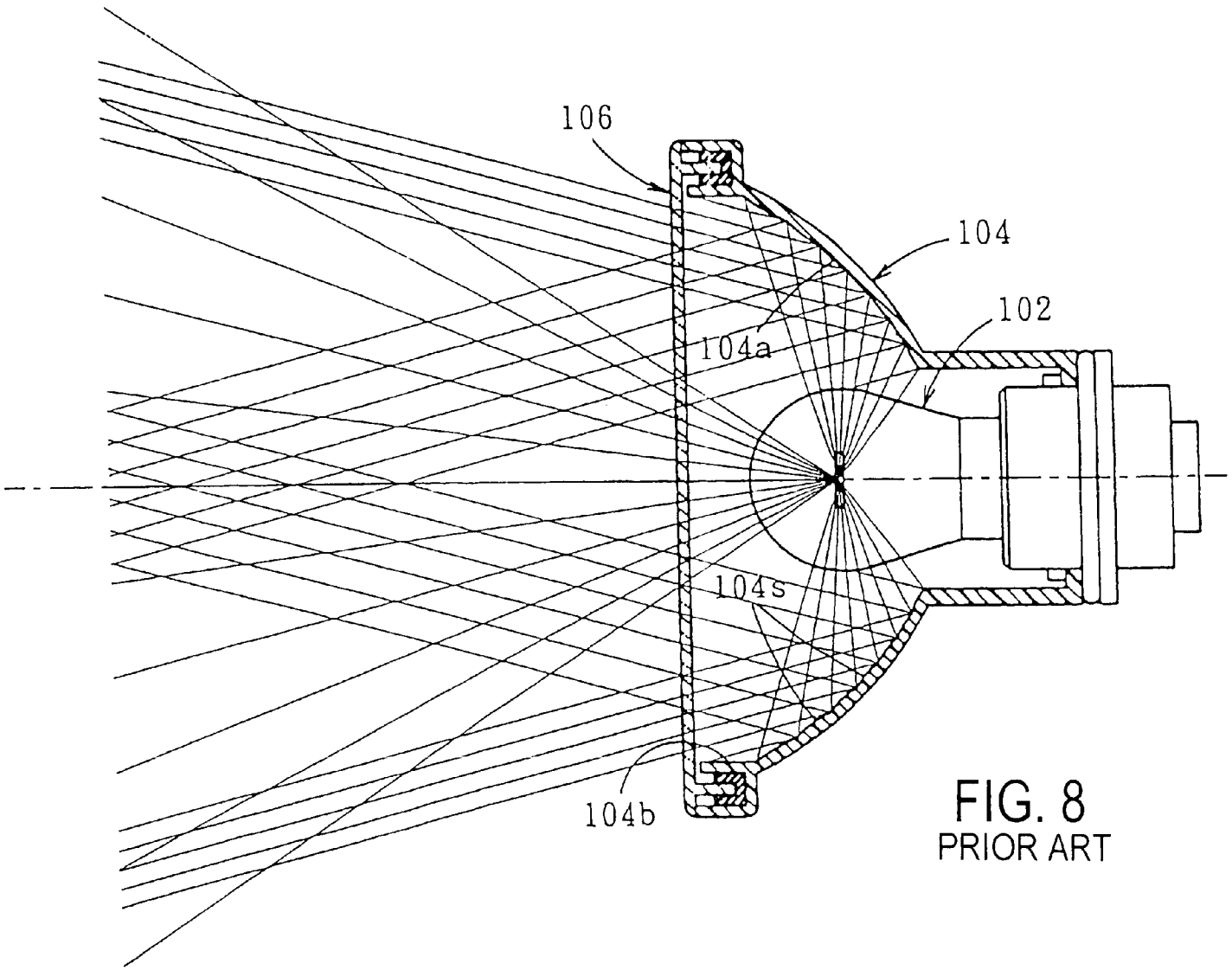
FIG. 8 PRIOR ART
FIG. 8 is a cross-sectional side view of a conventional vehicle indicator lamp.

FIG. 6 is a view of a modified example of the foregoing embodiment shown in FIG. 2. FIG. 7 is a view of a light distribution pattern obtained by the present modified example of FIG. 6, similar to that shown in FIG. 4.

As shown in FIGS. 6 and 7, in the present modified example, the outer diameter of the condenser lens portion 16*a* is set to a value smaller than the bulb insertion hole 14*b*. Also, the first target light distribution pattern P1 and the second target light distribution pattern P2 are different light distribution patterns.

In the modified example, the center region of the target light distribution pattern P includes a second target light distribution pattern P2 formed by the condenser lens portion 16*a*. The peripheral edge region of the target light distribution pattern P is constructed of a first target light distribution pattern P1 formed by the reflective surface 14*a*. The shape of the reflective surface 14*a* in order to obtain the first target light distribution pattern P1 and the shape of the condenser lens portion 16*a* in order to obtain the second target light distribution pattern P2 are determined according to the same procedures explained above in the foregoing embodiment.

Also in the present modified example, the reflective surface 14*a* of the reflector 14 is formed such that the inner peripheral edge region 14*a*1 thereof radiates reflected light in a direction substantially parallel to the lamp fixture reference axis Ax (approximately in a direction near the lamp fixture reference axis Ax). The outer peripheral edge region 14*a*2 thereof radiates reflected light in a direction near the light fixture reference axis Ax. This structure prevents the diffused and reflected light from being blocked by the light-source bulb 12 and the standing wall 14*c* of the outer peripheral side of the reflective surface 14*a*, thereby substantially eliminating the loss of reflected light. Further, the operation and effect substantially similar to those of the foregoing embodiment relating to other points as well are achieved.

According to the foregoing embodiment, in the shape determination procedure of the reflective surface 14*a* and the condenser lens portion 16*a*, the first target light distribution pattern P1 and the second target light distribution pattern P2 are divided into a plurality of pattern regions of a concentric elliptical shape with the lamp fixture reference axis Ax as the center. When changing to this type of geometric division method, it is possible to employ a method whereby the first target light distribution pattern P1 and the second target light distribution pattern P2 are stratified and divided, and have a width of predetermined luminosity. Furthermore, the foregoing embodiment is constructed to obtain a target light distribution pattern of a front turn signal lamp by synthesizing the first target light distribution pattern P1 and the second target light distribution pattern P2. However, it may also be designed and constructed to obtain the target light distribution pattern of a front turn signal lamp with only a reflective surface 14*a* , or only with a condenser lens portion 16*a*.

In the foregoing embodiments the vehicle indicator lamp 10 is a front turn signal lamp. However, operation and effects similar to that of the foregoing embodiments can be achieved by employing a similar construction in other vehicle indicator lamps as well such as in a clearance lamp, a tail lamp, a stop lamp, and a back-up lamp, for example.

What is claimed is:

1. A vehicle indicator lamp including a light-source bulb arranged in a lamp fixture reference axis that extends in a front/rear direction, a reflector which diffuses and reflects the light from the light-source bulb, and a transparent lens in front of the reflector, comprising:

a reflective surface divided into a plurality of reflective regions divided concentrically with the lamp fixture reference axis as the center, and formed such that the inner peripheral edge region of the reflective surface radiates reflected light in a direction substantially parallel to the lamp fixture reference axis while the outer peripheral edge region of the reflective surface radiates reflected light in a direction near the lamp fixture reference axis; and a condenser lens portion which focuses the light from the light-source bulb near the lamp fixture reference axis, the condenser lens positioned in front of the lamp-source bulb in the transparent lens.

2. The vehicle indicator lamp according to claim 1, wherein the shape of the reflective surface is determined by dividing a light distribution pattern into a plurality of pattern regions and calculating the light beam required to obtain radiated light corresponding to the light distribution pattern for each pattern region, while dividing the reflective surface into the plurality of reflective regions corresponding to each pattern region at the solid angle required to obtain the light beam calculated for each pattern region, and setting the gradient distribution of each reflective region such that the reflected light from the reflective region is radiated to each pattern region.

3. The vehicle indicator lamp according to claim 1, wherein the reflective surface is formed such that substantially all of the diffused and reflected light from the reflective surface is transmitted to a transparent lens portion positioned around the condenser lens portion.

4. The vehicle indicator lamp according to claim 1, wherein the shape of the condenser lens portion is determined by dividing the light distribution pattern which should radiate according to the transparent light of the condenser lens portion into a plurality of pattern regions and calculating the light beam required to obtain the radiated light of the pattern region for each pattern region, while dividing the condenser lens portion into a plurality of lens regions corresponding to each pattern region at the solid angle required to obtain the light beam calculated for each pattern region, and setting the prism vertical angle distribution of each lens region such that the transparent light from the lens region is radiated to each pattern region.

5. A vehicle lamp, comprising:

a reflector for diffusing and reflecting light from a light source bulb, the light source bulb having a reference axis, wherein the reflector includes a reflective surface divided into a plurality of reflective regions divided concentrically with the reference axis as the center, and an inner peripheral edge region that reflects light in a direction substantially parallel to the reference axis and includes an outer peripheral edge region that reflects light in a direction close to the reference axisi a transparent lens connected to the reflector; and a condenser lens connected to the transparent lens in front of the light source bulb.

6. The vehicle lamp of claim 5, further comprising a nontransparent covering over an outer peripheral edge portion of the transparent lens.

7. A method for designing a vehicle lamp to substantially eliminate the loss of reflected light, the vehicle lamp including a light source bulb, a reflector and a transparent lens, comprising:

dividing a reflective surface having a smooth surface without steps and ridges of the reflector into a plurality of concentric reflective regions centered about the reference axis;

determining the shape of an inner peripheral edge region of the reflector to reflect light in a direction substantially parallel to a reference axis of the light source bulb; and determining the shape of an outer peripheral edge of the reflector to reflect light in a direction close to the reference axis by dividing a first target light distribution pattern into a plurality of pattern regions and calculating the shape of the reflector to produce the light beam required to realize the distribution pattern for each pattern region; and utilizing a condenser lens to focus direct light from the light source bulb.

8. The method of claim 7, wherein the shape of the condenser lens is determined by:

dividing a second target light distribution pattern into a plurality of pattern regions; and calculating the shape of the condenser lens to produce the light beam required to realize the distribution pattern for each pattern region.

* * * * *